US005536460A

United States Patent [19]

Kuse

[11] Patent Number: 5,536,460

[45] Date of Patent: Jul. 16, 1996

[54] METHOD OF FORMING END STOPS MOLDED ON A SLIDE FASTENER CHAIN AND A CHAIN SPLITTING APPARATUS USED THEREIN

[75] Inventor: Kazuki Kuse, Toyama-ken, Japan

[73] Assignee: YKK Corporation, Tokyo, Japan

[21] Appl. No.: 315,618

[22] Filed: Sep. 30, 1994

[30] Foreign Application Priority Data

Oct. 20, 1993 [JP] Japan ..... 5-262389

[51] Int. Cl.[6] ..... B29C 37/00; B29C 45/14

[52] U.S. Cl. ..... 264/161; 29/408; 29/767; 264/252; 264/275; 425/545; 425/553; 425/814; 425/DIG. 51

[58] Field of Search ..... 29/408, 767; 264/40.7, 264/161, 252, 273, 275, 278; 425/545, 814, 553, DIG. 51

[56] References Cited

U.S. PATENT DOCUMENTS

| | | | |
|---|---|---|---|
| 4,368,570 | 1/1983 | Morita | 29/408 |
| 4,462,154 | 7/1984 | Morita | 29/408 |
| 4,627,807 | 12/1986 | Kuse | 264/252 |
| 4,640,008 | 2/1987 | Kuse | 29/767 |
| 4,787,140 | 11/1988 | Watanabe et al. | 29/767 |
| 5,054,183 | 10/1991 | Mayerhofer | 29/408 |

FOREIGN PATENT DOCUMENTS

| | | |
|---|---|---|
| 0089002 | 9/1983 | European Pat. Off. . |
| 0160983 | 11/1985 | European Pat. Off. . |
| 0213599 | 3/1987 | European Pat. Off. . |
| 62-42410 | 3/1987 | Japan . |
| 1-28564 | 6/1989 | Japan . |

*Primary Examiner*—Robert Davis
*Attorney, Agent, or Firm*—Hill, Steadman & Simpson

[57] ABSTRACT

A method of forming end stops to a continuous slide fastener chain including element-free space portions at longitudinally spaced intervals, wherein as the chain is fed in the backward direction, a pair of rows of interengaged coupling elements extending on the downstream side of an element-free space portion is spread open by a chain splitting apparatus for subsequent molding of a separable end stop whereas a pair of rows of coupling elements on the upstream side of the element-free space portion is kept in engaged condition. After the separable end stop is molded, the chain is fed in the forward direction during which time a sprue portion and gate portions formed integrally with the separable end stop are caught by a chain splitting member of the chain splitting apparatus. The chain splitting member is then lowered to automatically remove the sprue portion and gate portions from the separable end stop.

4 Claims, 4 Drawing Sheets

METHOD OF FORMING END STOPS MOLDED ON A SLIDE FASTENER CHAIN AND A CHAIN SPLITTING APPARATUS USED THEREIN

BACKGROUND OF THE INVENTION

1. Field of the Invention

The present invention relates to a method of continuously forming a pair of top end stops, or a separable bottom end stop composed of a separable pin and a box pin, molded integrally on a continuous slide fastener chain at each of successive element-free spaces formed in the slide fastener chain at longitudinal intervals, and a chain splitting apparatus suitable for use in the end-stop forming method.

2. Description of the Prior Art

It has been customary to continuously attach various types of end stops, such as top end stops, bottom end stops, and separable bottom end stops composed of separable pins and box pins, by an end-stop attaching apparatus to a continuous slide fastener chain (hereinafter referred to, for brevity, as "chain") at ends of element-free space portions formed in the chain at longitudinal intervals. In this instance if the end stops are of the type which are composed, such as top end stops or separable bottom end stops, of a pair of end stop members to be attached to inner longitudinal edges of a pair of fastener tapes (hereinafter referred to, for brevity, as "tapes"), there is a need to spread open each of the element-free portions so that the two end stop members can be readily inserted in the element-free space portion and subsequently attached to the inner longitudinal edges of the tapes.

For a purpose of spreading the element-free space portions, two typical methods have been used as disclosed, for example, in Japanese Utility Model Laid-open Publication No. 62-42410 and Japanese Patent Publication No. 1-28564, respectively. The first spreading method employs a chain splitting member which is inserted into an element-free space portion of a chain so as to disengage some interengaged coupling elements progressively from opposite ends of the element-free portion. In the second spreading method, two parallel spaced stringers jointly forming a chain and having successive spaced rows of disengaged coupling elements are fed simultaneously while they are properly positioned for the attachment of the end stop members.

In a continuous slide-fastener manufacturing system, the chain is passed through various processes, such as finishing of woven tapes, attachment of coupling elements, and application of reinforcing films before it is introduced into the end-stop attaching process. During that time, since the chain is repeatedly tensioned and slackened, difficulties would arise in maintaining the desired dimensional accuracy of the two tapes throughout the processes. According to a conventional practice, the portions to be processed are positioned at each procces to maintain the dimensional accuracy. However, it still retains the possibility that a dimensional difference created between the two tapes is increased during a prolonged continuous run of the manufacturing system. Especially, in the case of the end-stop attaching process in which the interengaged rows of coupling elements are partly disengaged to forcibly spread open the tapes as in the first spreading method described above, it occurs likely that when the disengaged rows of coupling elements located next to the element-free space portion are reengaged in a subsequent process, the dimensional accuracy between the two tapes is lowered or deteriorated, thereby causing various problems.

In the end-stop attaching process in which the aforesaid second spreading method is used, the opposed, fully disengaged rows of coupling elements are engaged together throughout the length thereof after the attachment of the end stop members is completed. In this instance, however, since a dimensional difference between the two tapes tends to be increasingly large in the preceding processes, a position of engagement between the opposed rows of coupling elements is liable to deviate from a desired point.

SUMMARY OF THE INVENTION

With the foregoing drawbacks of the prior art in view, it is an object of the present invention to provide a method of forming end stops molded on a continuous slide fastener chain in element-free space portions at longitudinally spaced intervals, in which interengaged rows of coupling elements are separated or disengaged progressively from only one end of the element-free space portion and hence can readily be reengaged in a short period of time, in which the end stops can be molded with high positioning accuracy, and in which unnecessary molded portions, such as a sprue portion and gate portions formed integrally with the end stops, can automatically be removed from the end stops.

To attain the foregoing object, the present invention provides in one aspect a method of forming end stops molded on a continuous slide fastener chain having a pair of stringer tapes and element-free space portions extending at longitudinally spaced intervals between successive spaced interengaged rows of coupling elements attached to inner longitudinal edges of the stringer tapes, the method comprising the steps of: (a) feeding the slide fastener chain longitudinally in a forward direction successively through an injection molding apparatus and through a chain splitting apparatus until one of the element-free spaces arrives at a position directly above the chain splitting apparatus; (b) then, activating the chain splitting apparatus so that a chain splitting member of the chain splitting apparatus is forced into the element-free space portion; (c) thereafter, feeding the slide fastener chain in a backward direction until a pair of endmost coupling elements located next to a downstream end of the element-free space portion abut respectively on a pair of positioning portions in a mold of the injection molding apparatus, thereby splitting open a portion of one pair of interengaged rows of coupling elements located on the downstream side of the element-free space portion; (d) then, while the mold is closed, injection-molding a molten synthetic resin material in the mold to form a pair of end stop members integrally molded on the respective stringer tapes at the element-free space portion, with a sprue portion and gate portions integrally molded with and disposed between the pair of end stop members; (e) subsequently, when the mold is open, feeding the slide fastener chain again in the forward direction, thereby causing the sprue portion and the gate portions to be lockingly engaged by the chain splitting member; (f) upon engagement between the sprue portion and the gate portions with the chain splitting member, activating the chain splitting apparatus again to retract the chain splitting member from the element-free space portion, thereby removing the sprue portion and the gate portions from the pair of end stop members; and (g) thereafter, repeating the preceding steps (a)–(f) in the sequence set forth.

Further, the present invention provides a method in which after the removal of the sprue portion and the gate portion, the splitted rows of coupling elements E are guided and coupled again at a joining portion of a Y-shaped chain guide groove formed on a lower block of a second guide chain by the feeding of the chain C.

In another aspect the present invention provides a chain splitting apparatus for use in the method described above, the apparatus comprising a vertically movable chain splitting member including a locking portion for locking engagement with the sprue portion and the gate portions that interconnect and extend between the pair of end stop members molded on the slide fastener chain. According to a preferred embodiment, the locking portion is bifurcated and receptive of the sprue portion with the gate portions lying below and extending transversely across the bifurcated locking portion.

To carry out the method of the invention, first of all, upper and lower chain guide means are vertically moved toward each other by a suitable actuator, such as a fluid-pressure cylinder (not shown), in response to the instructions received from a control unit so that the slide fastener chain while at rest is gripped between the upper and lower chain guide means. Then, a forward feed means is driven to feed the chain in a forward direction. During the forward movement of the chain, an element-free space portion in the chain in which a separable bottom end stop is to be molded is detected by a space-detection means, whereupon the chain is further advanced by a predetermined distance based on a signal from the space-detection means, and at the end of the predetermined distance, the forward feed of the chain is stopped. When the chain is stopped, the element-free space portion has already passed between upper and lower mold members of the mold and arrives at a position directly above the chain splitting apparatus.

Then, the chain splitting apparatus is driven to move the chain splitting member upwardly until the chain splitting member plunges into the element-free space portion with its downstream end edge confronting the interengaged rows of coupling elements. Thereafter, a reverse feed means is driven temporarily to feed the chain in the backward direction by a predetermined distance whereupon the interengaged rows of coupling elements are separated or disengaged by the chain splitting member inserted in the element-free space portion. In this instance, the distance of backward feed of the chain is determined such that an upstream end of the element-free space portion is received in a chain guide portion of the lower mold member, and endmost two of the disengaged coupling elements located next to the downstream end of the element-free space are spaced downstream from the positioning portions of the lower mold member.

Subsequently, the upper and lower chain guide means and the chain splitting member are concurrently lowered so that a portion of the chain extending across the mold is placed in the chain guide portions in the lower mold member. Then, the reverse feed means is activated again to feed the chain in the backward direction whereupon the partly disengaged rows of coupling elements are further separated by the chain splitting member. As the reverse feed of the chain continues, the endmost two of the disengaged coupling elements are brought into abutment with the positioning portions, respectively, in the lower mold member. Upon detection of this abutting engagement, the reverse feed means is stopped. In this instance, the chain is stretched or tensioned with a predetermined pulling or tensional force.

Then, the upper mold member is lowered to close the mold, and after that a molten synthetic resin material is injected from an injection nozzle into the mold so that a pair of end stop members are molded integrally on respective inner longitudinal edges of the tapes at the downstream end of the element-free space, with the end stop members interconnected by a pair of aligned gate portions integrally formed with a sprue portion. Thereafter, the mold is opened. In this instance, the chain guide means and the chain splitting member are concurrently moved upwardly to separate the chain from the lower mold member. As the upper mold member further moves upwardly, the chain is separated from the upper mold member. Then, the forward feed means is driven again to feed the chain in the forward direction while the chain is guided by the chain guide means. The forward movement of the chain causes the sprue portion to be caught or lockingly engaged by the bifurcated locking portion of the chain splitting member, with the gate portions lying under and extending transversely across the bifurcated locking portion. Then, the chain splitting apparatus is driven to lower the chain splitting member with the sprue portion and the gate portions engaged therewith. With this downward movement of the chain splitting member, the sprue portion and the gate portions are separated from the end stop members and subsequently fall by gravity down by means of a known discharge means by which the sprue portion and gate portions are discharged from the end-stop forming apparatus.

The foregoing sequence of operation should be construed as illustrative rather than restrictive. Another sequence of operation may be employed so long as the object of the invention can be attained.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
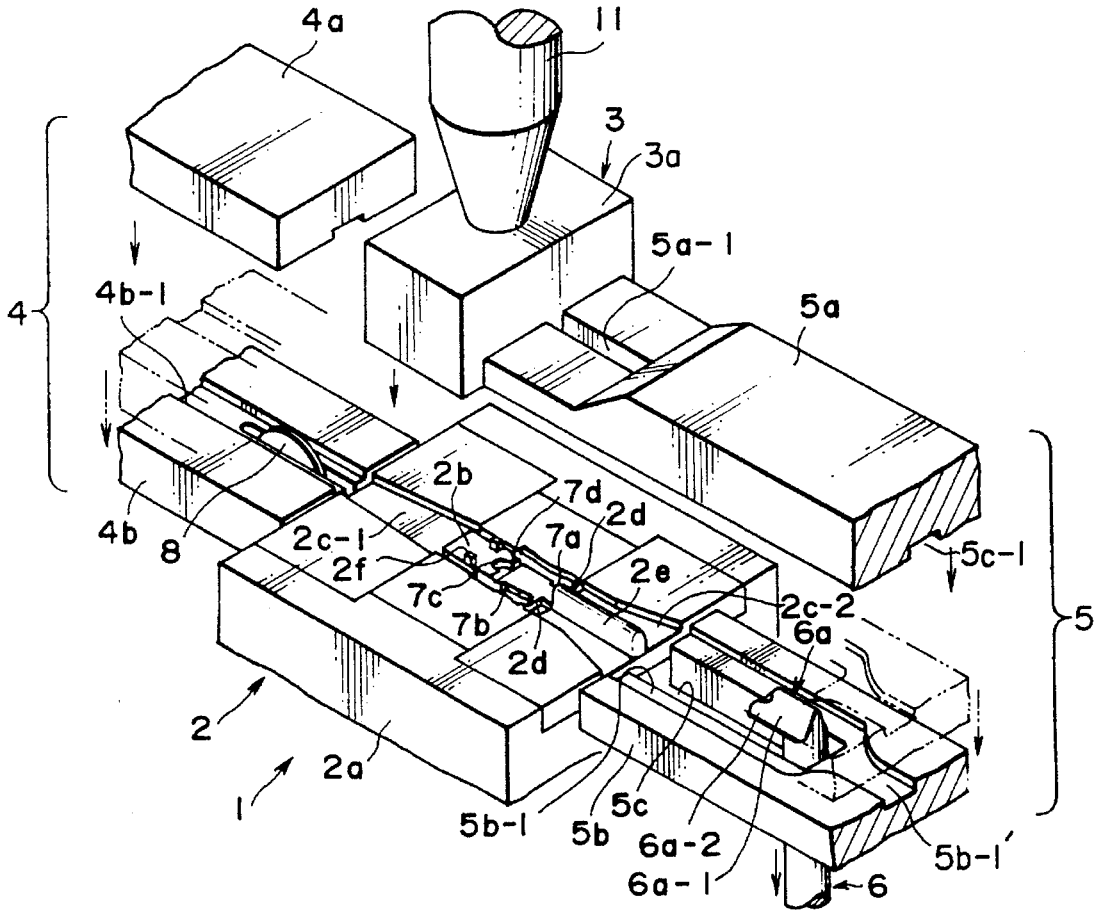
FIG. 1 is a perspective view showing a main portion of an apparatus used for carrying out a method of the present invention for forming end stops molded on a continuous slide fastener chain.

The present invention will be described in greater detail with reference to a typical example illustrated in the accompanying sheets of drawings. FIG. 1 shows in perspective a typical separable-bottom-end-stop forming apparatus 1 used for achieving a method of this invention for forming separable bottom end stops molded on a continuous slide fastener chain C. The apparatus 1 consists of a vertical or upright injection-molding machine disposed in a chain feed path along which the chain C (FIG. 2) is fed. The apparatus includes a mold composed of a lower fixed mold member 2 and an upper movable mold member 3, a first chain guide 4 disposed adjacent to an upstream end of the upper and lower mold members 3 and 2, a second chain guide 5 disposed adjacent to a downstream end of the upper and lower mold members 3 and 2, and a chain splitting apparatus 6 vertically movable in the second chain guide 5.

The lower fixed mold member 2 is fixed at a predetermined position and includes a lower mold plate 2*a* and a lower die 2*b* firmly fitted in a central portion of the lower mold plate 2*a*. The lower fixed mold member 2 further includes first and second chain guide grooves 2*c*-1 and 2*c*-2 which are respectively contiguous to upstream and downstream ends of a portion of the chain feed path defined in the lower die 2*b* and which flare in a direction from their upstream end toward downstream end. The lower die 2*b* includes a mold surface includes a first cavity 7*a* for molding a separable pin of the separable bottom end stop, a second cavity 7*b* for molding a box pin of the separable end stop, a sprue end 7*c* defining an end of a sprue, and a pair of gates 7*d* communicated at one end with the sprue end 7*c* and connected at opposite end to the first and second cavities 7*a* and 7*b*, respectively. The first and second cavities 7*a*, 7*b* are out of phase by half the pitch of each of coupling elements E (FIG. 2) of the chain C in the direction parallel to the chain feed path. A pair of abutment surfaces (positioning portions) 2*d* is formed in the mold surface of the lower die 2*b* for abutment with a pair of coupling elements E to position the chain C relative to the first and second cavities 7*a*, 7*b*. The abutment surfaces 2*d* are each located between one of the first and second cavities 7*a*, 7*b* and the second chain guide groove 2*c*-2. An elongated guide member or ridge 2*e* is disposed centrally in, and extends longitudinally of, the second chain guide groove 2*c*-2 for guiding two stringers of the chain C in a separated condition.

The upper movable mold member 3 includes an upper mold plate 3*a* and an upper die (not shown) firmly fitted in the upper mold plate 3*a*. Though not shown, the upper die has a mold surface formed in mirror-image symmetry with the mold surface of the lower die 2*b* and defines a sprue extending through the upper die at a position corresponding the position of the sprue end 7*c* in the lower die 2*b*. In FIG. 1 reference character 2*f* designates a pair of positioning projections formed on the mold surface of the lower die 2*b* for holding the two stringers in parallel spaced condition to enable accurate molding of the separable pin and the box pin. The upper mold member 3 has a pair of positioning recesses (not shown) formed at a position corresponding to the position of the positioning projections 2*f* for receptive engagement with the positioning projections 2*f*.

The first chain guide 4 is composed of an upper block 4*a* and a lower block 4*b* disposed in vertical confrontation with the chain feed path lying centrally therebetween. The lower block 4*b* has in its upper surface a chain guide groove 4*b*-1 longitudinally aligned with the first chain guide groove 2*c*-1 of the lower mold member 2. The lower block 4*b* is provided with a space-detection roller 8 rotatably disposed in a slit (not designated) extending longitudinally along a central portion of the chain guide groove 4*b*-1. The space-detection roller 8 rotatably mounted in the slit partly projects from the upper surface of the lower block 4*b*. The space-detection roller 8 is vertically movable and is connected with a suitable switch means such as a microswitch (not shown) so that in response to vertical movement of the space-detection roller 8, the microswitch is turned on and off. The space-detection roller 8 is normally urged upwardly. Though not shown, the upper block 4*a* has in its lower surface a chain guide groove vertically confronting the chain guide groove 4*b*-1, and a guide recess for loosely receiving therein the space-detection roller 8.

The second chain guide 5 is constructed in the like manner as the first chain guide 4 and comprises an upper block 5*a* and a lower block 5*b* disposed in vertical confrontation with the chain feed path lying centrally therebetween. The lower block 5*b* has a generally U-shaped configuration provided as a result of formation of an elongated rectangular recess 5*c* extending from an upstream end toward a downstream end of the lower block 5*b* along a central portion thereof. The lower block 5*b* has in its upper surface a substantially Y-shaped chain guide groove 5*b*-1 extending along a generally U-shaped upper peripheral edge of the recess 5*c* and joining at the downstream end portion of the lower block 5*b*. The upper block 5*a* disposed above the lower block 5*b* has a length which is equal to the sum of the length of the lower block 5*b* and the length of the guide projection 2*e* on the lower mold plate 2*a*. The upper block 5*a* has an elongated opening 5*a*-1 loosely receptive of the guide projection 2*e*, an elongated rectangular recess (not shown) corresponding in position to the position of the recess 5*c* in the lower block 5*b*, and a substantially Y-shaped chain guide groove 5*c*-1 extending along a lower peripheral edge of the recess.

The upper and lower blocks 4*a*, 4*b*; 5*a*, 5*b* of each of the first and second chain guides 4, 5 are vertically and relatively movable toward each other. A lower limit of vertical movement of the lower blocks 4*b*, 5*b* is determined such that the respective upper surfaces of the lower blocks 4*b*, 5*b* lie flush with the mold surface of the lower fixed mold member 2. The upper and lower blocks 4*a*, 4*b*; 5*a*, 5*b* are driven at a timing which is automatically controlled together with the operation of the upper and lower mold members 3 and 2 in accordance with a sequence of operation preset in a control unit (not shown).

Figure 5:
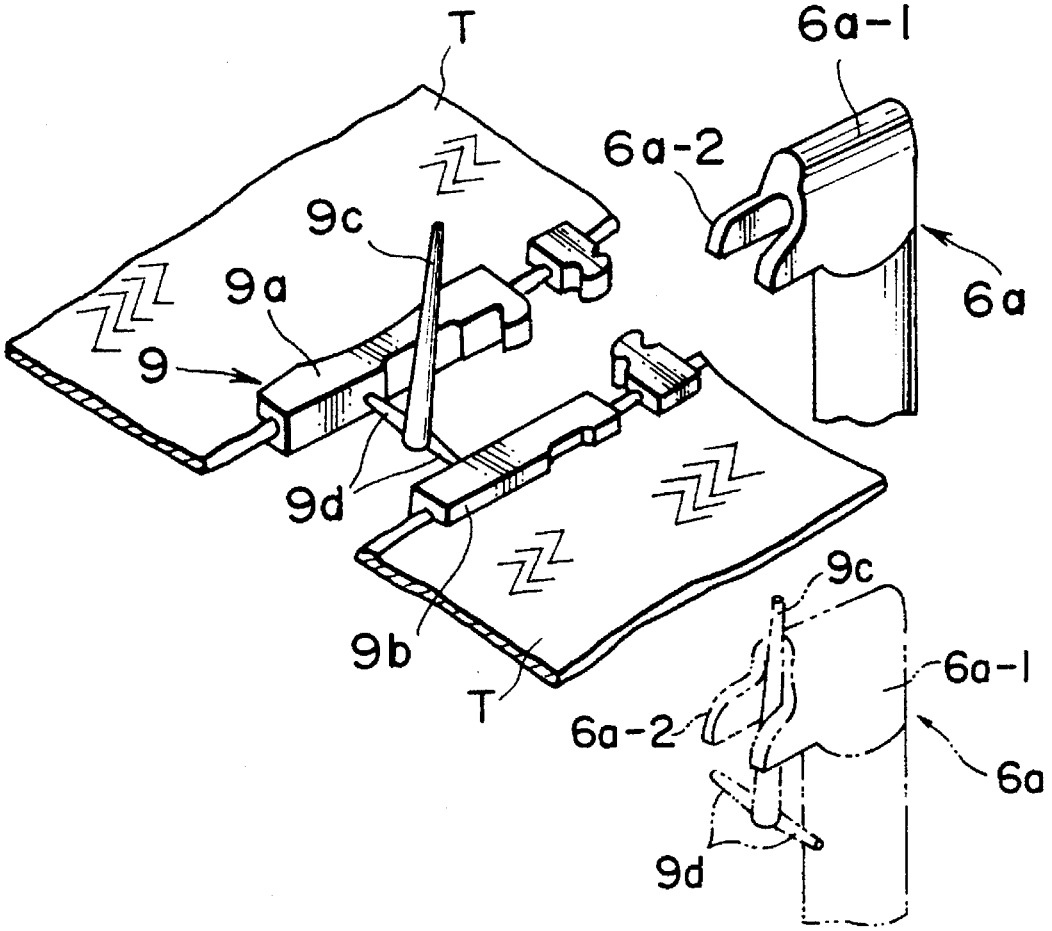
FIG. 5 is a fragmentary perspective view showing the operation of the chain splitting member of the apparatus.

In FIG. 1 numeral 6 denotes a chain splitting apparatus including a chain splitting member 6*a* which forms an important structural component of the present invention, and which is firmly connected to an outer end of the piston rod of a vertically disposed air cylinder (not shown). The chain splitting member 6*a* includes, as shown in FIGS. 1 and 5, a wedge-shaped body 6*a*-1 having a cross-sectional area increasing progressively from a top edge toward a downward direction, and a forked or bifurcated locking portion 6*a* projecting horizontally from a lower portion of the wedge-shaped body 6*a*-1 toward the upstream side of the chain feed path. The top edge of the wedge-shaped body 6*a*-1 extends parallel to the chain feed path, and an edge at the downstream end of the wedge-shaped body 6*a*-1 has an inverted V shape. The bifurcated locking portion 6*a*-2 is dimensioned such that a sprue portion 9*c* (FIG. 5) molded at the same time as end stop members (i.e., a separable pin and a box pin) by the end-stop forming apparatus 1 is lockingly received in the bifurcated locking portion 6*a*-2, and a pair of gate portions 9*d* (FIG. 5) also formed at the molding is engageable with a lower surface of the bifurcated locking portion 6*a*-2.

As shown in FIG. 1, the chain splitting apparatus 6 of the foregoing construction is disposed in a position where the chain splitting member 6*a* can be inserted upwardly into the recess 5*c* in the lower block 5*b* of the second chain guide 5. In response to operation of the air cylinder (not shown), the chain splitting member 6*a* is driven to project upwardly from the recess 5*c* in the lower block 5*b* or retract into the recess 5*c*. The air cylinder and the chain splitting member 6*a* are driven by instructions provided in accordance with the operation procedure stored in the non-illustrated control unit.

Figure 2:
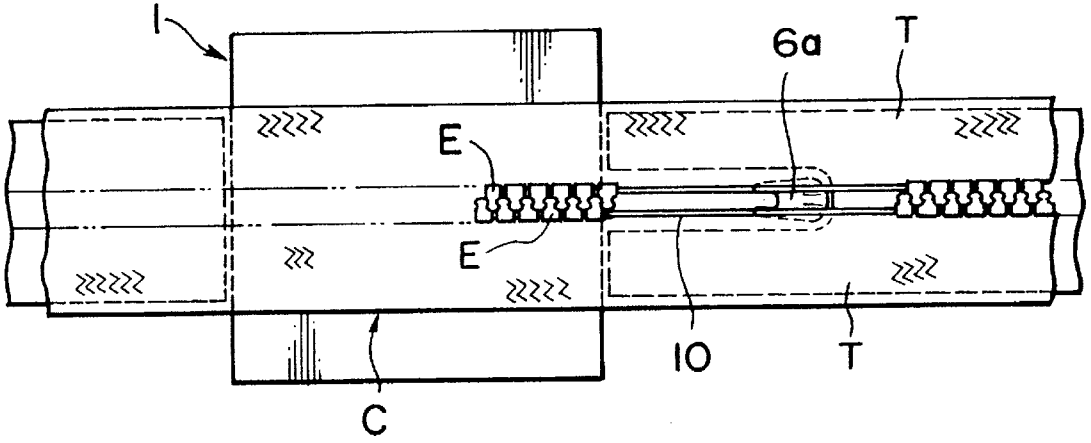
FIG. 2 is a plan view showing a condition in which a chain splitting member is inserted in an element-free space portion of the slide fastener chain.
Figure 3:
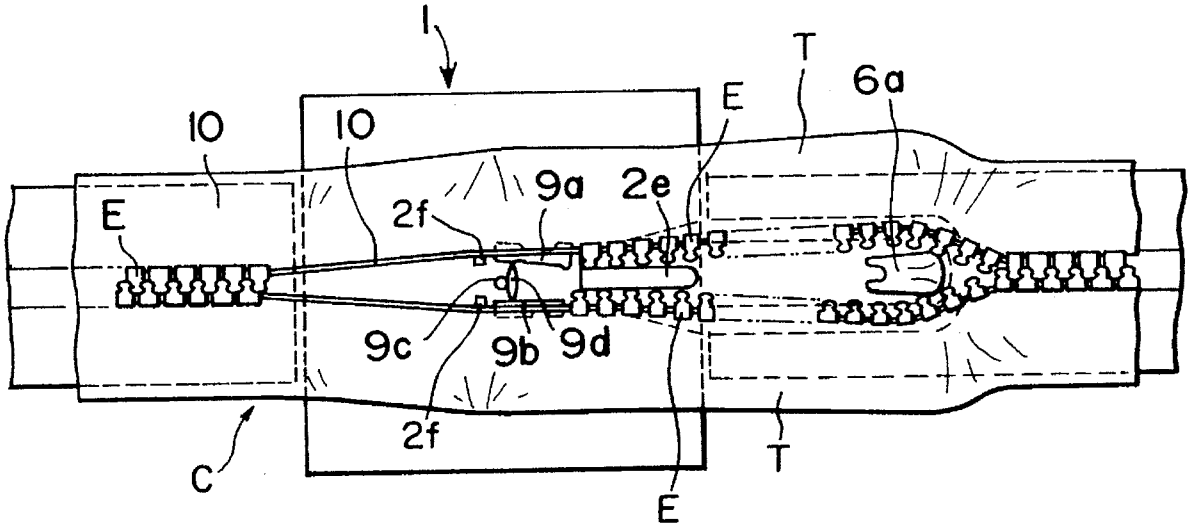
FIG. 3 is a plan view illustrative of a condition in which the slide fastener chain is set in a position ready for molding a separable end stop.
Figure 4:
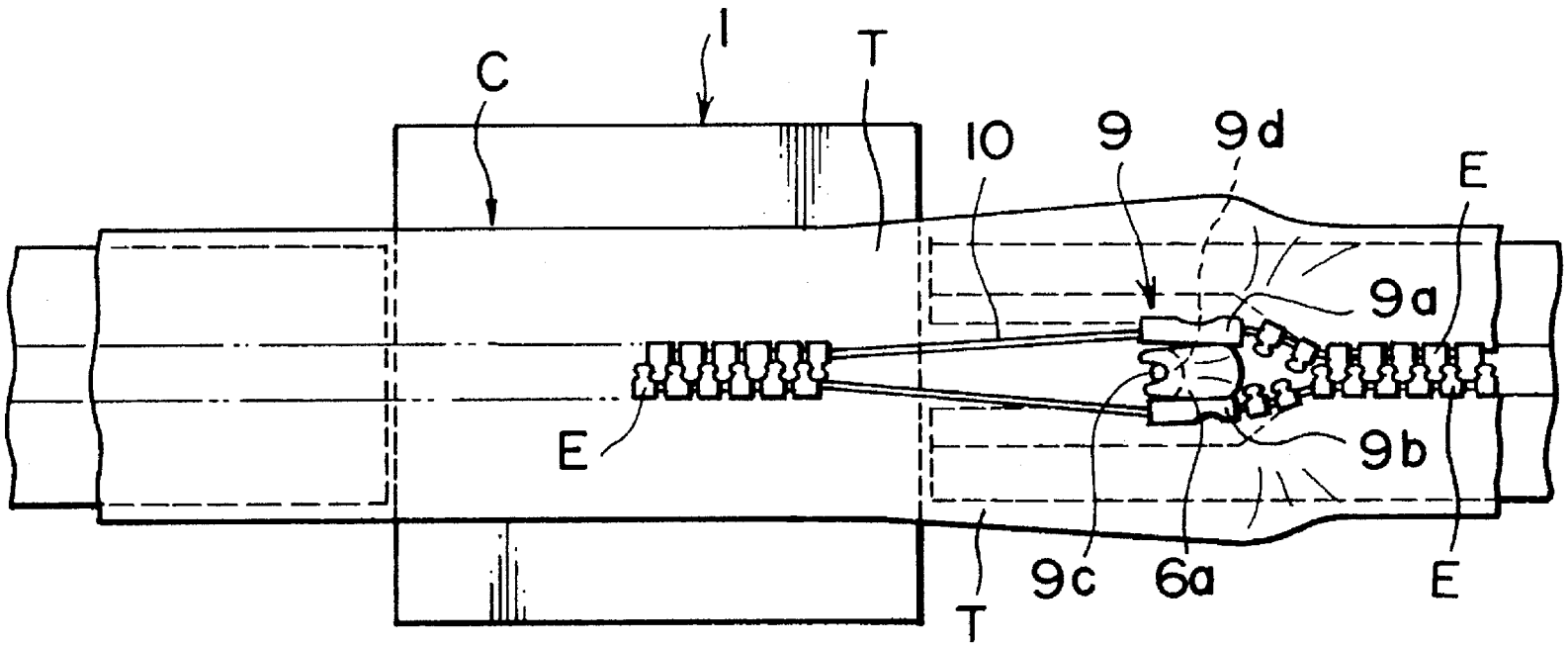
FIG. 4 is a plan view illustrative of a manner in which a sprue portion and gate portions are removed from the slide fastener chain.

FIGS. 2 through 4 show a sequence of operation of the injection-molding machine which is achieved to carry out the method of the present invention for forming a separable end stop molded on the chain C. The end-stop forming method of the present invention will be described below with reference to FIGS. 2–4 together with FIGS. 1 and 5.

At first, in response to the instructions received from the non-illustrated control unit, the upper and lower block members 4*a*, 4*b*; 5*a*, 5*b* of each of the first and second chain guides 4 and 5 are vertically, moved toward each other by a suitable actuator, such as a fluid-pressure cylinder (not shown), so that a chain C while at rest is gripped between the upper and lower block members 4*a*, 4*b*; 5*a*, 5*b*. Then, a feed roller (not shown) is driven to feed the chain C in a forward direction along the chain feed path. During the forward movement of the chain C, an element-free space portion or gap 10 in the chain C at which a separable bottom end stop (FIGS. 4 and 5) is to be molded is detected by the space-detection roller 8, whereupon the number of rotation of the space-detection roller 8 is counted. The forward movement of the chain C further continues until the counted number of rotation of the space-detection roller 8 reaches to a preset value. When the counted number of rotation of the space-detection roller 8 is equal to the preset value, rotation of the feed roller is stopped to terminate the forward movement of the chain C. In this instance, the element-free space portion 10, having passed through a space between the upper and lower mold members 3 and 2, arrives at a position directly above the chain splitting apparatus 6, as shown in FIG. 1 and 2. The preset number of rotation of the space-detection roller 8 is so determined as to realize the relative position between the element-free space portion 10 and the chain splitting apparatus 6 shown in FIG. 1. As an alternative, the stop position of the chain C may be determined such that the feed roller is stopped upon a lapse of a predetermined period of time running from detection of the element-free space portion 10 by the space-detection roller 8.

Then, the chain splitting apparatus 6 is driven to move the chain splitting member 6*a* upwardly until the chain splitting member 6*a* plunges into the element-free space portion 10 with its inverted V-shaped downstream end edge confronting the interengaged rows of coupling elements E. Thereafter, a reverse feed means composed of a reverse feed roller and a fluid-pressure cylinder (neither shown) is driven to feed the chain C in the backward direction by a predetermined distance whereupon the interengaged rows of coupling elements E are separated or disengaged by the chain splitting member 6*a* inserted in the element-free space portion 10. In this instance, the distance of the backward feed of the chain C is determined such that an upstream end of the element-free space portion 10 is receivable in the first chain guide groove 2*c*-1 of the lower mold member 2, and endmost two of the disengaged coupling elements located next to the downstream end of the element-free space portion 10 are spaced in the downstream direction from the abutment surfaces 2*d* of the lower die 2*b*.

Subsequently, the first and second chain guides 4, 5 and the chain splitting member 6*a* are concurrently lowered so that a portion of the chain C extending between the first and second chain guides 4, 5 is placed in the first and second chain guide grooves 2*c*-1 and 2*c*-2 in the lower fixed mold member 2. Then, the reverse feed means is activated again to feed the chain C in the backward direction whereupon the partly disengaged rows of coupling elements E are further separated by the chain splitting member 6*a*. As the reverse feed of the chain C continues, the endmost two of the disengaged coupling elements E are brought into abutment with the abutment surfaces 2*d*, respectively, as shown in FIG. 3. This abutting engagement is detected by a suitable detecting means to stop operation of the reverse feed means. When the reverse fed means is stopped, the chain C is stretched or tensional with a predetermined pulling or tensioning force.

Then, the upper mold member 3 is lowered to close the mold, and after that a molten synthetic resin material is injected from an injection nozzle 11 into the cavities 7*a*, 7*b* through the sprue, sprue end 7*c*, and gates 7*d* in the mold. As a result of this injection molding, a separable pin 9*a* and a box pin 9*b* are molded integrally on respective inner longitudinal edges of the tapes T at the downstream end of the element-free space portion 10, as shown in FIG. 3, with the pins 9*a*, 9*b* interconnected by a pair of aligned gate portions 9*d* integrally formed with a sprue portion 9*c*. Thereafter, the mold is opened. In this instance, the first and second chain guides 4, 5 and the chain splitting member 6*a* are concurrently moved upwardly so that the chain C is separated from the lower mold member 2. As the upper mold member 3 further moves upwardly, the chain C is separated from the upper mold member 3. Then, the non-illustrated feed roller is driven again to feed the chain C in the forward direction while the chain C is guided by the first and second chain guides 4, 5. The forward movement of the chain C causes the sprue portion 9*c* to be caught or lockingly engaged by the bifurcated locking portion 6*a*-2 of the chain splitting member 6*a*, with the gate portions 9*d* lying under and extending transversely across the bifurcated locking portion 6*a*-2, as shown in FIG. 4. Then, the chain splitting apparatus 6 is driven to lower the chain splitting member 6*a* with the sprue portion 9*c* and the gate portions 9*d* engaged therewith. With this downward movement of the chain splitting member 6*a*, the sprue portion 9*c* and the gate portions 9*d* are separated from the separable pin 9*a* and box pin 9*b* and subsequently fall by gravity down onto a suitable discharge device (not shown) by means of which the sprue portion 9*c* and the gate portions 9*d* are discharged from the end-stop forming apparatus 1.

Then, the rows of coupling elements E splitted after the removal of the sprue portion 9*c* and the gate portions 9*d* are guided to the joining portion 5*b*-1' of the Y-shaped chain guide groove 5*b*-1 formed on the lower block 5*b* of the second guide chain 5, and then they are coupled again at the joining portion 5*b*-1' by the feeding of the chain C.

The foregoing cycle of operation may automatically be repeated to successively mold separable bottom end stops 9 to the chain C in respective element-free space portions 10 with high positioning accuracy while automatically removing sprue portions 9*c* and gate portions 9*d* by the chain splitting member 6*a*. In the embodiment described above, the end stop to be molded comprises a separable pins 9*a* and a box pins 9*b* which constitute a separable bottom end stop 9. It is obvious however that the present invention may be applied in molding a top end stop of the general type.

It appears from the foregoing description that according to the method of the present invention for molding end stops on a continuous slide fastener chain at longitudinally spaced intervals, a group of interengaged coupling elements on the downstream side of an element-free space portions are separated or disengaged by a chain splitting apparatus, while the coupling elements on the upstream side of the element-free space portion are kept in an interengaged condition. Accordingly, the disengaged coupling elements can readily be reengaged in a short period of time after the end stop members are molded on the chain, Subsequent to the molding, the chain is fed forwardly during which time a sprue portion and gate portions that are formed integrally with the molded end stop members are automatically ,caught or engaged by the chain splitting member of the chain splitting apparatus. Thereafter, as the chain splitting member moves downwards, the sprue portion and the gate portions are automatically removed from the end stop members. Thus, partial separation or disengagement of the interengaged rows of coupling elements and removal of the sprue portion and gate portions can be achieved at the same station. With this arrangement, the productivity of the end-stop forming apparatus is greatly improved, the necessary mechanism can be simplified, and the necessary space can be greatly reduced.

Obviously, various minor changes and modifications of the present invention are possible in the light of the above teaching. It is therefore to be understood that within the scope of the appended claims the invention may be practiced otherwise than as specifically described.

What is claimed is:

1. A method of forming end stops molded on a continuous slide fastener chain having a pair of stringer tapes and element-free space portions extending at longitudinally spaced intervals between successive spaced interengaged rows of coupling elements attached to inner longitudinal edges of the stringer tapes, said method comprising the steps of:

(a) feeding the slide fastener chain longitudinally in a forward direction successively through an injection molding apparatus and through a chain splitting apparatus until one of the element-free space portions arrives at a position directly above said chain splitting apparatus;

(b) then, activating said chain splitting apparatus so that a chain splitting member of said chain splitting apparatus is forced into the element-free space portion;

(c) thereafter, feeding the slide fastener chain in a backward direction until a pair of endmost coupling elements located next to a downstream end of the element-free space portion abut respectively on a pair of positioning portions in a mold of the injection molding apparatus, thereby splitting open a portion of one pair of interengaged rows of coupling elements located on a downstream side of the element-free space portion;

(d) then, while the mold is closed, injection-molding a molten synthetic resin material in the mold to form a pair of end stop members integrally molded on the respective stringer tapes at the element-free space portion, with a sprue portion and gate portions integrally molded with and disposed between the pair of end stop members;

(e) subsequently, while the mold is open, feeding the slide fastener chain again in the forward direction, thereby causing the sprue portion and the gate portions to be lockingly engaged by said chain splitting member;

(f) upon engagement between the sprue portion and the gate portions and said chain splitting member, activating said chain splitting apparatus again to retract said the chain splitting member from the element-free space portion, thereby removing the sprue portion and the gate portions from the pair of end stop members; and (g) thereafter, repeating the preceding steps (a)–(f) in the sequence set forth.

2. A method of forming end stops molded on a continuous slide fastener chain according to claim 1, wherein opposite said rows of coupling elements splitted after the sprue portion and the gate portions have been removed are guided to a joining portion of a Y-shaped chain guide groove formed on a lower block of a second guide chain, and then coupled again at said joining portion by the feeding of the chain.

3. A chain splitting apparatus for use in a method of forming end stops molded on a continuous slide fastener chain having a pair of stringer tapes and element-free space portions extending at longitudinally spaced intervals between successive spaced interengaged rows of coupling elements attached to inner longitudinal edges of the stringer tapes, comprising a vertically movable chain splitting member including a locking portion for locking engagement with a sprue portion and gate portions that interconnect and extend between a pair of end stop members molded on the slide fastener chain.

4. A chain splitting apparatus according to claim 3, wherein said locking portion is bifurcated and receptive of the sprue portion with the gate portions lying below and extending transversely across said bifurcated locking portion.

* * * * *